US011840368B2

(12) United States Patent
Tibbets

(10) Patent No.: US 11,840,368 B2
(45) **Date of Patent: *Dec. 12, 2023**

(54) MEAT TRAY

(71) Applicant: Peerless Machine & Tool Corporation, Marion, IN (US)

(72) Inventor: Michael Eugene Tibbets, Converse, IN (US)

(73) Assignee: Peerless Machine & Tool Corporation, Marion, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/067,984

(22) Filed: Dec. 19, 2022

(65) Prior Publication Data

US 2023/0122963 A1 Apr. 20, 2023

Related U.S. Application Data

(63) Continuation of application No. 16/739,267, filed on Jan. 10, 2020, now Pat. No. 11,535,417.

(60) Provisional application No. 62/795,240, filed on Jan. 22, 2019.

(51) Int. Cl.
*B65D 1/34* (2006.01)

(52) U.S. Cl.
CPC ..... *B65D 1/34* (2013.01)

(58) Field of Classification Search
CPC . B65D 1/34; B65D 1/40; A47G 19/00; A47G 19/02; A47G 19/03
See application file for complete search history.

(56) References Cited

U.S. PATENT DOCUMENTS

| | | | | |
|---|---|---|---|---|
| 5,088,640 | A * | 2/1992 | Littlejohn | A47G 19/03 220/574 |
| 5,326,020 | A * | 7/1994 | Cheshire | B65D 1/34 229/407 |
| 6,695,138 | B1 * | 2/2004 | Colombo | B65D 81/2084 428/36.5 |
| 6,715,630 | B2 * | 4/2004 | Littlejohn | A47G 19/03 229/407 |
| 11,535,417 | B2 * | 12/2022 | Tibbets | B65D 1/34 |
| 2010/0264202 | A1 * | 10/2010 | Littlejohn | A47G 19/03 229/406 |

* cited by examiner

*Primary Examiner* — Javier A Pagan
(74) *Attorney, Agent, or Firm* — Barnes & Thornburg LLP

(57) ABSTRACT

A meat tray sized and shaped to support raw meat is provided. The meat tray is composed of a paperboard material. The meat tray may include a generally planar base extending to a sidewall that extends transversely from the planar base to an angled outer transition which forms an outer periphery of a tray cavity. A rim of the meat tray is located at a terminus of the angled outer transition and extends away from the cavity. The rim may include an outer arcuate rim portion that extends and curves away from the outer transition and a planar flange extending from the outer arcuate rim portion and terminates at an edge. The edge faces downwardly with respect to the outer arcuate rim portion.

20 Claims, 13 Drawing Sheets

MEAT TRAY

RELATED APPLICATIONS

The present Application is a continuation of U.S. patent application Ser. No. 16/739,267, filed on Jan. 10, 2020 entitled "Meat Tray," and claims priority to U.S. Provisional patent application Ser. No. 62/795,240, filed on Jan. 22, 2019. The subject matter disclosed in these references is hereby expressly incorporated into the present Application in its entirety.

TECHNICAL FIELD AND SUMMARY

The present disclosure is related to paperboard storage trays and methods of making same. In particular, this disclosure is related to disposable meat storage trays that are shaped to resist edge wicking which causes flange failure/deformation under the compressive forces of plastic shrink wrap, and to dies for making the disposable meat storage trays.

Uncooked meats, for purposes of this disclosure, include beef, chicken, pork, and even fish are sold in virtually every supermarket or grocery store in the United States. Typically, these meats are packaged and sold in clear plastic-wrapped foam meat trays and displayed in the meat case at the supermarket or grocery store. Specifically, regarding the meat trays, they are typically made of expanded polystyrene foam. These polystyrene meat trays are inexpensive, but may have recyclability issues not unlike previously used polystyrene foam hamburger clamshells. Polystyrene foam hamburger clamshells have generally been replaced with paperboard or cardboard clamshells.

Indeed, cardboard or paperboard materials are now commonly used for fast food burger clamshells, paper plates, trays, containers, etc. These paper plates, trays, and containers are typically made by stamping either sheets or webs of cardboard or paperboard between multiple dies to form the paperboard into the desired shape. In other instances, the paperboard or cardboard is folded into shape. Cardboard or paperboard, however, cannot be used as a meat tray to store and display at the supermarket because of moisture and time.

Uncooked meats of every variety have the common characteristic of being moist. Undoubtedly, this moisture will wick up the edges of any would-be paperboard or cardboard alternative meat tray. This is despite the fact that, typically, plates, trays, and containers have coated surfaces that work well for holding moist materials such as food. Disposable and recyclable paper plates, trays, and containers have been developed with different poly coatings that make their surfaces water resistant. The paperboard may have a surface coating that works well to support moist meat in a grocery case for often days or even longer. The vulnerability of any poly coated paperboard plate, tray, or container, however, is its edges. When the poly coated paperboard is formed and cut to shape, the edge or rim of the resulting paperboard container is exposed. The poly coating is not present at the container's edge or rim. It is common knowledge that paperboard material is very susceptible to degradation in the presence of moisture. This is where time becomes a factor. Even if not immediately, moisture will migrate to the edges of any paperboard or cardboard alternative meat tray and begin to wick. Eventually, as the moisture wicks into the body of the paperboard or cardboard, it will begin breaking down.

Because moist meat will be stored in a grocery case for days or longer, as well as being moved around to different orientations during stocking and purchasing, it is very likely moisture from the meat will come into contact with the edge of a conventionally shaped paperboard tray or container. Even the exterior poly wrapping that typically surrounds the uncooked meat in the foam tray will not prevent liquid from migrating to the edge or rim of a conventional cardboard or paperboard tray.

Another problem with replacing polystyrene with paperboard is not only edge wicking, but also pricing. The more elaborate the attempt is to isolate the exposed edge or rim of the liquid of uncooked meat, the more the solution will cost. The complexity and cost of the dies used, as well as the time to make the tray, inherent difficulty in forming a tray with a rolled or wipe-down flange (i.e., production jam-ups do not clear themselves out), increased die maintenance, and increased forming stress on the paperboard translates into higher cost. To make a viable alternative paperboard meat tray to polystyrene, pennies count. The tray has to be manufacturable quickly and must be as inexpensive (i.e., simple) as possible. Otherwise, it may not be a reasonable alternative for polystyrene foam meat trays. As such, the dies should be as simple as possible and have as few parts as necessary to produce the meat tray.

Accordingly, an illustrative embodiment of the present disclosure provides a meat tray sized and shaped to support raw meat. The meat tray is composed of a paperboard material. The meat tray comprises: a generally planar base extending to a sidewall that extends transversely from the planar base to an angled outer transition which forms an outer periphery of a tray cavity; wherein a reference plane extends from the angled outer transition of the meat tray opposite the generally planar base; and a rim of the meat tray is located at a terminus of the angled outer transition and extends away from the cavity. The rim includes a planar transition that extends from the angled outer transition and from the cavity. An outer arcuate rim portion extends from the planar transition. The outer arcuate rim portion curves away from the reference plane. A planar flange extends from the outer arcuate rim portion and terminates at an edge.

In the above and other illustrative embodiments, the meat tray may further comprise: the planar transition having a span extending from angled outer transition of about 0.001 inches to about 1 inch; the angled outer transition has a radius and the radius of the angled outer transition divided by a height of the meat tray is equal to or greater than about 0; the outer rim has a radius and the radius of the outer rim divided by a height of the meat tray is equal to or greater than about 0; a transition located between the generally planar base and the sidewall; the transition is located between the generally planar base and the sidewall and has a radius, wherein the radius of the transition divided by a height of the meat tray is equal to or greater than about 0; the outer rim has a length, wherein the length of the outer rim divided by a height of the meat tray is less than or equal about 1; the planar flange has a length and the length of the planar flange divided by length of the outer rim is less than about 1; the sidewall may be angled with respect to a line about perpendicular to the generally planar base within a range of about 5° to about 80°; the planar flange may be angled with respect to a line about perpendicular to the generally planar base within a range of about 0° to about 80°; and the edge faces away from the reference plane.

Another illustrative embodiment of the present disclosure provides a meat tray sized and shaped to support raw meat. The meat tray is composed of a paperboard material. The meat tray comprises: a generally planar base extending to a sidewall that extends transversely from the planar base to an angled outer transition which forms an outer periphery of a tray cavity; a rim of the meat tray is located at a terminus of the angled outer transition and extends away from the cavity; wherein the rim includes an outer arcuate rim portion that extends and curves away from the outer transition; and a planar flange extending from the outer arcuate rim portion and terminates at an edge; wherein the edge faces downwardly with respect to the outer arcuate rim portion.

In the above and other illustrative embodiments, the meat tray may further comprise: a planar transition that extends from the angled outer transition and from the cavity; the outer arcuate rim portion extends from the planar transition; a reference plane that extends from the angled outer transition of the meat tray opposite the generally planar base; the outer arcuate rim portion curves away from the reference plane; the angled outer transition has a radius and the radius of the angled outer transition divided by a height of the meat tray is equal to or greater than about 0; the outer rim has a radius and the radius of the outer rim divided by a height of the meat tray is equal to or greater than about 0; a transition is located between the generally planar base and the sidewall; the outer rim has a length, and wherein the length of the outer rim divided by a height of the meat tray 2 is less than or equal about 1; and the planar flange has a length and the length of the planar flange divided by length of the outer rim is less than about 1.

Additional features and advantages of the meat tray will become apparent to those skilled in the art upon consideration of the following detailed descriptions of carrying out the meat tray as presently perceived.

BRIEF DESCRIPTION OF THE DRAWINGS

The concepts described in the present disclosure are illustrated by way of example and not by way of limitation in the accompanying figures. For simplicity, and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Corresponding reference characters indicate corresponding parts throughout the several views. The exemplification set out herein illustrates embodiments of the meat tray, and such exemplification is not to be construed as limiting the scope of the meat tray in any manner.

DISCLOSURE OF ILLUSTRATIVE EMBODIMENTS

Figure 1:
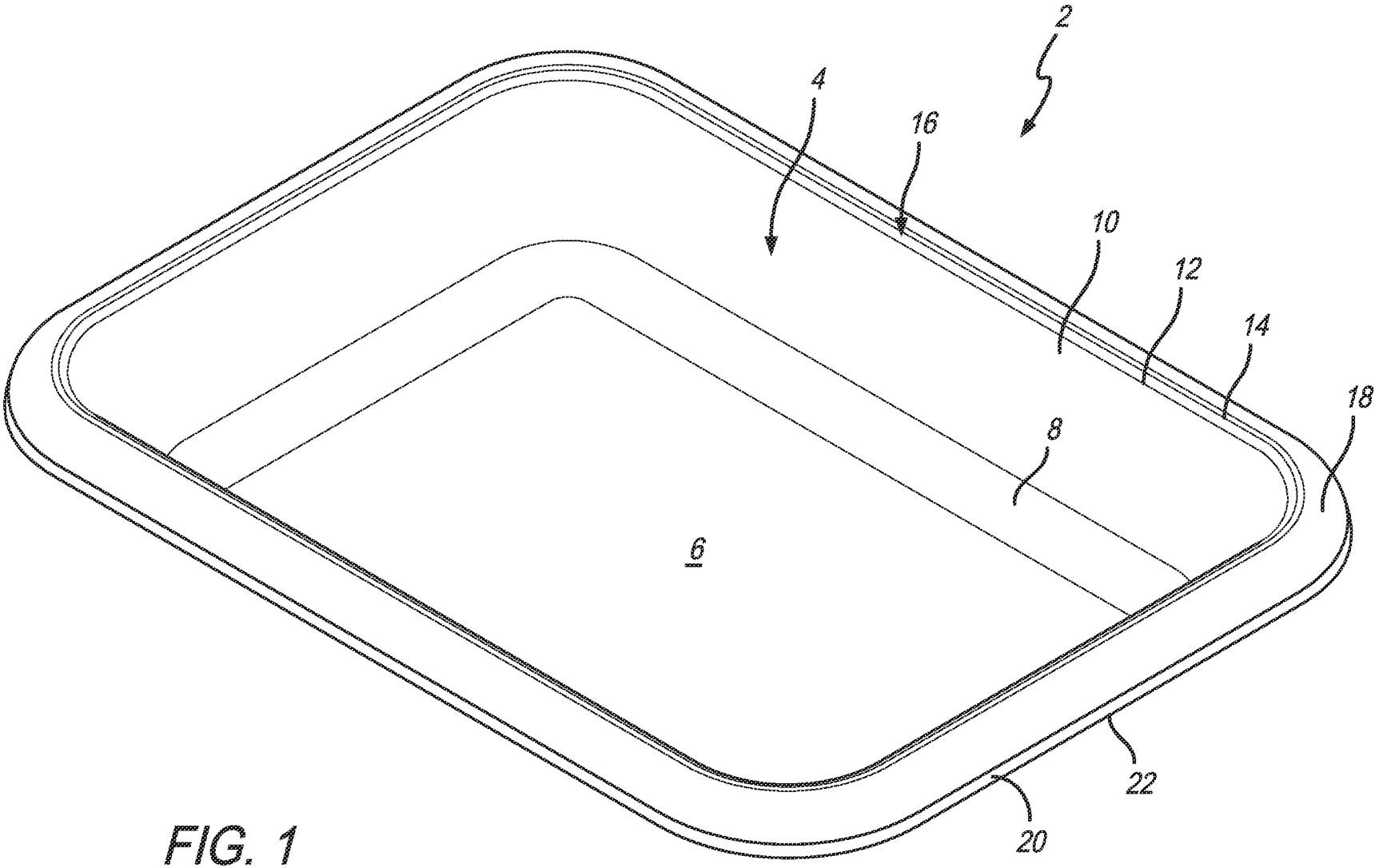
FIG. 1 is a top perspective view of the illustrative embodiment of a paperboard meat tray.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

An illustrative embodiment of the present disclosure provides a paperboard or cardboard (for purposes of this disclosure, cardboard and paperboard may be used interchangeably) plate, tray, or container (again, collectively identified for purposes of this disclosure, as "tray") that provides a curved rim adjacent its periphery that terminates in a plane or flange causing the rim edge to be oriented substantially downward so the surface of the rim edge is directed downward relative to and away from the tray cavity. Adding the plane or flange onto the outer rim reduces the possibility of liquid that originates in the tray cavity to migrate and contact with the edge of the rim. The flange also creates a larger sealing surface in conjunction with the sealing wrap and may also increase sidewall and flange strength. When this tray is used in conjunction with a flexible plastic wrap, a conventional means of sealing meat in a foam tray, surprising and unexpected results have been produced in which moisture from the meat located in the tray cavity does not migrate past the surface of the outer rim and contact the edge of same. The tendency of the plastic wrap to seal against this outer flange appears to prevent moisture migration, protecting the exposed outer edge.

A further illustrative embodiment of the meat tray of the present disclosure includes a stamped paper blank that has a generally planar base (a portion of which may either be flat, domed, arched, or combination and/or variation of same) and bounded at its periphery by a curved or angled base transition portion. This base transition portion extends generally upwardly to an inclined sidewall. Such sidewall may be inclined, acutely, obtusely, or vertically, with respect to the generally planar base or a plane that extends through the planar base. The plane may be a surface configured to support the meat tray such as a countertop, table, or other like supporting surface. At an upper end of the inclined sidewall, opposite the base transition, is a curved or angled outer transition. This outer transition may illustratively form the interior upper edge of the tray. In an illustrative embodiment, extending from the outer transition is a planar transition. This planar transition extends generally parallel to at least a portion of the generally planar base or other plane. It is appreciated that this planar transition extends away from the tray's cavity. Extending from the planar transition, opposite the outer transition, is an outer rim. This outer rim curves downwardly both away from the tray cavity and towards the plane that may support the general planar base of the tray. Extending from that outer rim, opposite the planar transition, is a planar flange. This planar flange forms the outer edge of the tray opposite the outer rim. The outer edge is itself a surface that is the terminus between the inner and outer surfaces of the paperboard that forms the tray.

As the paperboard has a thickness and is cut into a particular shape, the coating on the top and/or bottom surfaces of the paperboard is interrupted at the edge. The paperboard material exposed at this edge is the body of the paperboard. In other words, there is no coating on the edge and, thus, no moisture resistant properties. Indeed, any moisture coming into contact with the paperboard body at this edge will cause the moisture to be absorbed or wicked into the paperboard body. Hence, the edge is kept away from the cavity of the meat tray. The distance the exposed edge is from the cavity, combined with the tendency of the plastic wrap to seal against the outer flange, appears to prevent moisture migration and to protect the exposed outer edge.

In an illustrative embodiment, an approximately 8 15/16 inch wide tray may include an about one-half inch radiused upward extending curved radius for its base transition. The inclined sidewall may extend upward at approximately 120° from the generally planar base, or about 30° from vertical, extending from the generally planar base. The angled outer transition, extending from the inclined sidewall, opposite the curved base transition, may have a radius of about 1/16 inch. The planar transition extending from the angled outer transition may extend about 0.100 inches away from the opening of the cavity and located opposite the general planar base. The outer rim may have an illustrative radius of approximately 5/16 inch. The planar flange extending from the outer rim may have a length of 3/32 inch. In a further illustrative embodiment, the height of the outer rim extending from the planar transition down to the edge of the planar flange may illustratively be about 5/16 inch. The skilled artisan will appreciate that these measurements and dimensions are approximations and only demonstrative of an illustrative embodiment to assist in further understanding the character of the disclosed meat trays. It will be appreciated that the disclosed meat trays may be formed with alternative dimensions yet maintain the characteristics of the meat trays disclosed herein. Such alternative meat trays are contemplated to be within the scope of this disclosure.

Another illustrative embodiment of the present disclosure provides a stamped paperboard blank formed into a paperboard tray having a generally planar base, upwardly extending curved base transition, inclined sidewall, and angled outer transition. This embodiment, in contrast to the prior embodiment, includes an outer rim formed from the angled outer transition, rather than a planar transition located therebetween. In other words, there is no planar transition surface located between the angled outer transition and the outer rim. A planar flange extends from the outer rim, opposite the angled outer transition, forming the outer edge of the tray. In this illustrative embodiment, the dimensions of the curve base transition, inclined sidewall, angled outer transition, outer rim, and planar flange may be similar or the same as that previously discussed with the prior embodiment. It will be appreciated by the skilled artisan upon reading the present disclosure that the meat tray dimensions disclosed herein are illustrative and alternate dimensions may be used instead depending on the need of the tray configuration. Such alternate dimensions are contemplated to be within the scope of the present disclosure.

Another illustrative embodiment of the present disclosure provides a method of thermoforming or press-forming the meat tray. Again, an issue with achieving an actual paperboard meat tray is expense. The more sophisticated or complex the die arrangement and part count, the higher the cost. This inhibits producing a cost-effective paperboard meat tray. An illustrative embodiment of the present disclosure includes a method of making the meat tray using a paperboard press die-set that is simpler in the design than a comparable paperboard press die-set. For example, a wipe-down flange-forming die is composed of a male body supporting a spring-loaded male nose fitted within a draw ring and secondary draw ring which creates the "wipe-down" flange. Secondary draw ring actuating pins are included to support and actuate the secondary draw ring. A spring-loaded ironing ring, supported by the female cavity, sets on the actuated secondary draw ring. A flat paperboard blank is set between the spring-loaded male nose and female cavity to press form the tray shape. The draw ring, in combination with the actuated secondary draw ring and spring-loaded ironing ring, supported by the actuating pins, move to form the tray's rim and fold under the edge to move same away from the inside of the tray that otherwise supports the tray contents. An example of a wipe-down flange forming die is shown in U.S. patent application Ser. No. 15/713,913, entitled "Paperboard Tray With Fold-Over Flange," filed on Sep. 25, 2017, the disclosure of which is incorporated herein by reference in its entirety.

The illustrative embodiment of the present disclosure dispenses with the need of the actuated secondary draw ring and ironing ring actuating pins. Instead, the die-set of the present disclosure is composed of a male body and spring-loaded male nose fitted within a draw ring. A spring-loaded ironing ring is supported by the draw ring which fits underneath the female cavity. When the female cavity joins with the spring-loaded male nose, a paperboard blank position therebetween forms the paperboard tray shape. Particularly, when the female cavity and spring-loaded nose with male body are drawn together, they press the paperboard blank into the shape of the meat trays having the characteristics previously described. In the illustrative embodiment, the male body forms portions of the inclined sidewall while the spring-loaded male nose, a portion of which being fitted in the male body, illustratively, forms an additional portion of the inclined sidewall along with the curve base transition and generally planar base. When the male body and spring-loaded male nose engage the female cavity, it, along with the draw ring, forms the angled outer transition, planar transition, outer rim, and planar flange. In the alternative embodiment of the meat tray, the die may be modified so the draw ring and female cavity do not form the planar transition, but rather the outer rim and planar flange are formed from the angled outer transition. Without additional structures, such as the actuated secondary draw ring and secondary draw ring actuating pins, using the die structure to form the meat trays is simpler and, thus, less expensive to make and operate.

A top perspective view of an illustrative embodiment of a paperboard meat tray 2 is shown in FIG. 1. A tray cavity 4 is a predominant feature of paperboard meat tray 2. Tray cavity 4 is composed of generally planar base 6 and bounded by upward base transition 8 to inclined sidewall 10. It is appreciated that raw meat, such as that sold in grocery stores or meat markets, may be contained within tray cavity 4. It is also appreciated that the composition of paperboard meat tray 2 is that of a cardboard or paperboard blank die stamped to form the illustrative characteristics of paperboard meat tray 2 as shown. The top and bottom surfaces of the meat tray may have some poly coating on them to resist moisture produced by the meat from penetrating and degrading the paperboard. It is contemplated that both the structural design, as disclosed herein, in combination with the simplicity of the design and its manufacturer, contribute to produce a paperboard meat tray that can serve as an alternative to a conventional foam-based meat tray. Such a paperboard meat tray would be more environmentally friendly than the conventional foam tray, while its simplicity in design and manufacturer make it a cost-realistic alternative. Unexpectedly, the distance the exposed edge is from the cavity combined with the tendency of the plastic wrap to seal against the outer flange appears to prevent moisture migration to protect the exposed outer edge.

Extending from inclined sidewall 10, opposite upward base transition 8, is angled outer transition 12. Adjacent angled outer transition 12, opposite inclined sidewall 10, is an illustrative planar transition 14. This planar transition 14 is an illustrative flat surface surrounding outer periphery 16 of tray cavity 4. Adjacent planar transition 14, located opposite angled outer transition 12, is outer rim 18. It is contemplated that as much of the portions of paperboard meat tray 2 that are either in contact with, adjacent to, or in proximity of the meat, should have coated paperboard surfaces. This helps prevent the possibility of moisture from the meat coming into contact with non-coated surfaces of the paperboard. Additionally, a rim surrounding outer periphery 16 has a utility of creating a grip structure for plastic wrap or other covering over tray cavity 4 to seal the meat therein. Conventionally, even with meat stored in foam trays, both the meat and tray are wrapped in transparent plastic wrap which allows view of the meat contained therein whilst sealing it off from the outside environment. Likewise, paperboard meat tray 2 may be wrapped with similar plastic wrapping to seal the meat from the outside environment as well. Alternatively, a rigid covering may be employed to fit over tray cavity 4 and attached to outer rim 18. The curved rim does two things—increases rigidity of the flange so it can withstand the compressive forces of the plastic shrink-wrap and provides a large smooth shaped surface for the plastic shrink-wrap to seal against as it is stretched over and around the tray. It is further appreciated that the illustrated shape of outer periphery 16 of paperboard meat tray 2 is rectangular. The skilled artisan upon reading the present disclosure will appreciate that this shape is demonstrative as it is a general shape of prior art conventional foam meat trays. The skilled artisan will further appreciate that the shape of the paperboard meat tray 2 may alternatively be round, oval, square, triangular, or irregularly shaped, for example. Meat tray 2 may also be shaped similar to a conventional 3P or other industry standard size foam tray.

Extending downwardly with respect to outer rim 18 and the rest of the portions of paperboard meat tray 2 is planar flange 20. The straight planar surface of planar flange 20 has the effect of directing edge 22 downwardly while outer rim 18 is spaced apart from outer periphery 16 of tray cavity 4. It is appreciated that edge 22 is the outer most structure of the paperboard blank that will form paperboard meat tray 2. This is of particular issue because, although the top and bottom surfaces of the paperboard blank will be coated with a moisture resistant coating, the edge of such blank will not. The net effect is that, although the majority of either side of the paperboard blank will be resistant to moisture, the edge will instead be particularly vulnerable. This is because, paperboard blanks, when cut, create edges that do not include any moisture resistant coating. This means the exposed edge may wick any moisture that it comes in contact with, thereby, degrading the paperboard from the inside, a condition the surface coatings cannot prevent. And again, unexpectedly, the distance the exposed edge is from the cavity, combined with the tendency of the plastic wrap to seal against the outer flange, appears to prevent moisture migration to protect the exposed outer edge.

Figure 2:
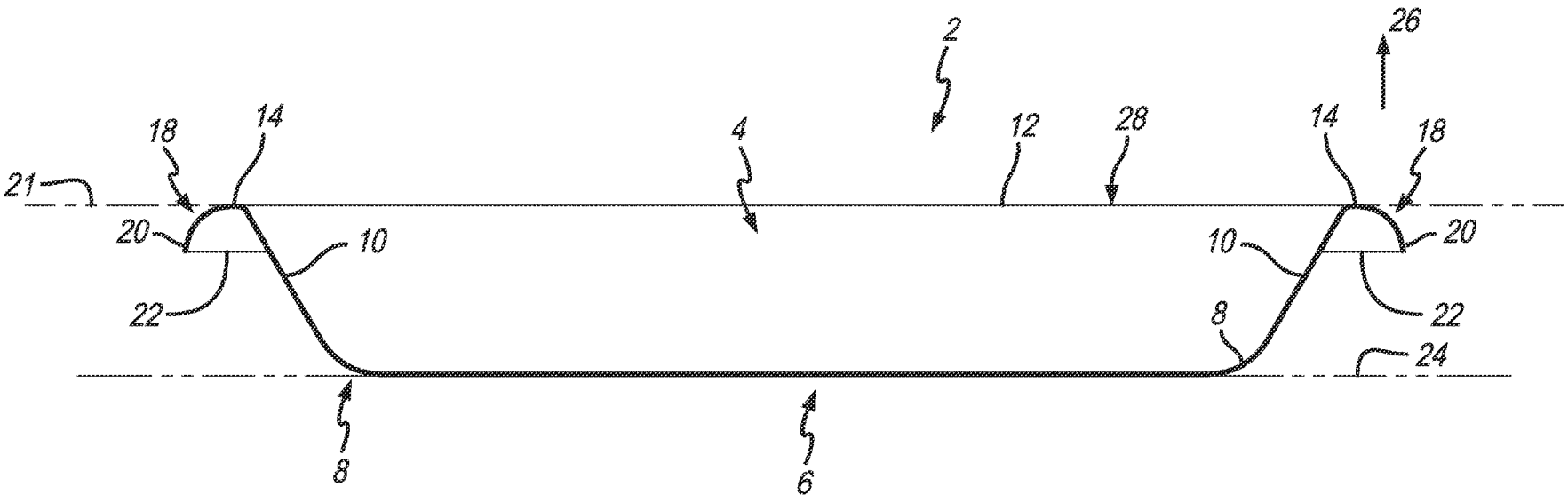
FIG. 2 is a side cross-sectional view of the paperboard meat tray.

A side cross-sectional view of paperboard meat tray 2 is shown in FIG. 2. This view shows planar base 6, which is configured to sit on a surface such as a table or counter top surface as indicated by line 24. It is appreciated that at least a portion of planar base 6 may be raised with respect to line 24 and bowed or otherwise have some space between the underside of planar base 6 and line 24. This view also better shows upward base transition 8 extending upwardly from planar base 6. Upward base transition 8 extends to inclined sidewall 10 opposite planar base 6. Inclined sidewall 10 extends illustratively both upward, generally in direction 26, and outwardly from tray cavity 4, to create the inclined angle as illustratively shown. It is appreciated that the angle of the inclined sidewall 10 may be at any useful transverse angle with respect to line 24. Planar base 6, along with upward base transition 8, inclined sidewall 10, and angle outer transition 12 form tray cavity 4 with opening 28, which will support whatever contents (i.e., raw meat) are placed into paperboard meat tray 2. It is also appreciated that the height of tray cavity 4, as defined by those same structures (upward base transition 8, inclined sidewall 10, and angled outer transition 12), may be vertically adjustable upward or downward to provide a deeper or shallower tray cavity as needed for a particular application. The top of meat tray 2 identified by reference plane 21. Reference plane 21, like line 24, is an imaginary line or plane spaced apart from line 24 to assist in describing features of paperboard meat tray 2.

Extending outwardly away from tray cavity 4 at angled outer transition 12 is planar transition 14. The linear surface of the planar transition 14 forms outer rim 18. By extending outer rim 18 away from tray cavity 4, edge 22 is likewise positioned away from tray cavity 4. As previously discussed, planar flange 20 extends between outer rim 18 and edge 22. This increases the distance the exposed edge is from the cavity. The curved surface of rim 18 is also shown directed away from reference plane 21.

Figure 3:
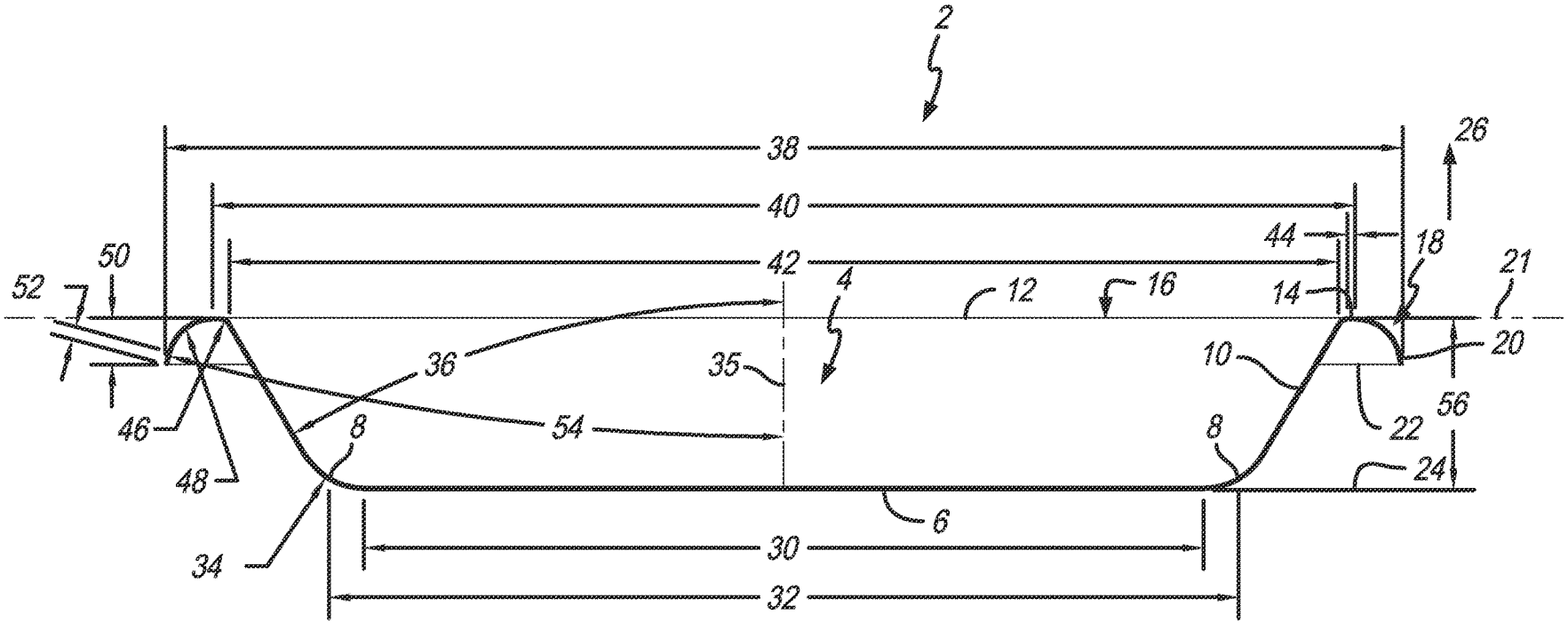
FIG. 3 is another side cross-sectional view of the paperboard meat tray.

Another side cross-sectional view of paperboard meat tray 2 is shown in FIG. 3. Accordingly, this view also shows planar base 6 with upward base transition 8 extending to inclined sidewall 10 terminating at planar transition 14, which forms outer periphery 16 of tray cavity 4. Similarly shown is planar transition 14 extending from angled outer transition 12 and leading to outer rim 18 and planar flange 20 terminating at edge 22. As part of an illustrative embodiment, illustrative dimensions have been assigned to the various structures of paperboard meat tray 2 in order to further illustrate its characteristics. It will be appreciated by the skilled artisan upon reading this disclosure that such dimensions are illustrative and may be adjusted as desired to create a tray for a particular purpose without departing from the scope of this disclosure. For example, in this illustrative embodiment, planar base 6 has a linear dimension of 6 1/16 inch as indicated by line 30. When adding the linear dimensions of the upward base transition 8, line 32 has a dimension of about 6 5/8 inch. In this illustrative embodiment, upward base transition 8 has a curved radius of about 1/2 inch as indicated by line 34. Inclined sidewall 10, extending upwardly generally in direction 26, may be angled with respect to line 35 oriented perpendicular to planar base 6 (and line 24) at about 30°, as indicated at 36. It is appreciated that angle 36 may range from about 5° to about 80°. As further shown, paperboard meat tray 2 may have an overall length as indicated by line 38 of about 8 15/16 inch with an illustrative tolerance of about +/−3/32 inch. The width of paperboard meat tray 2, excluding outer rim 18 and planar flange 20, may be about 8¼ inch with a tolerance of about +/−3/32 inch, as indicated by line 40. The length of tray cavity 4, at outer periphery 16, may be about 8 3/64 inch with a tolerance of about +/−3/32 inch as indicated by line 42. Furthermore, planar transition 14 may have a span extending from angled outer transition 12 of about 3/64 inch, and may have a range of about 0.001 inch to about 1 inch, as indicated at 44. In this illustrative embodiment, angled outer transition 12 may have a radius of about 1/16 inch as indicated at 46 and outer rim 18 may have a radius of about 5/16 inch as indicated at 48. Furthermore, outer rim 18 may have a height of about 5/16 inch as well, as indicated at 50. Planar flange 20 may have a length of about 3/32 inch as indicated at 52 and be angled at about 15° from perpendicular line 35, as indicated by line 54. It is appreciated that angle 54 may range from about 0° to about 80°. Lastly, in this embodiment, the height of paperboard meat tray 2 may be about 1¼ inch, as indicated by line 56. Again, these dimensions are illustrative and can be changed while still contemplated within the scope of this present disclosure.

In illustrative embodiments, various sizes of the radius identified at 34 for transition 8 are contemplated and may be reflected in a ratio of the radius identified at 34 divided by the height of meat tray 2 indicated by line 56 that are equal to or greater than about 0, where 0 may be a sharp corner intersection with no tangential radius. Likewise, in illustrative embodiments, various sizes of the radius indicated by 46 for angled outer transition 12 may also be reflected in a ratio of the radius indicated by 46 divided by the height of paperboard meat tray 2 indicated by line 56 that are equal to or greater than about 0. Again, 0 may be a sharp corner intersection with no tangential radius. In further illustrative embodiments, various sizes of the radius indicated by 48 for outer rim 18 may be reflected in a ratio of the radius identified at 48 divided by the height of paperboard meat tray 2 identified by line 56 that are equal or greater than about 0. Here, again, 0 may be a sharp corner intersection with no tangential radius. Illustrative heights of outer rim 18 indicated at 50 may be reflected in a ratio of the height indicated by 50 divided by the height of meat tray 2 indicated by 56 that are less than or equal about 1. Planar flange 20 may be any of a variety of illustrative lengths as indicated at 52 that are reflected in a ratio of the length identified by 52 divided by heights of outer rim 18 indicated at 50 that are less than about 1. Additionally, the top of meat tray 2 is identified by reference plane 21.

Figure 4:
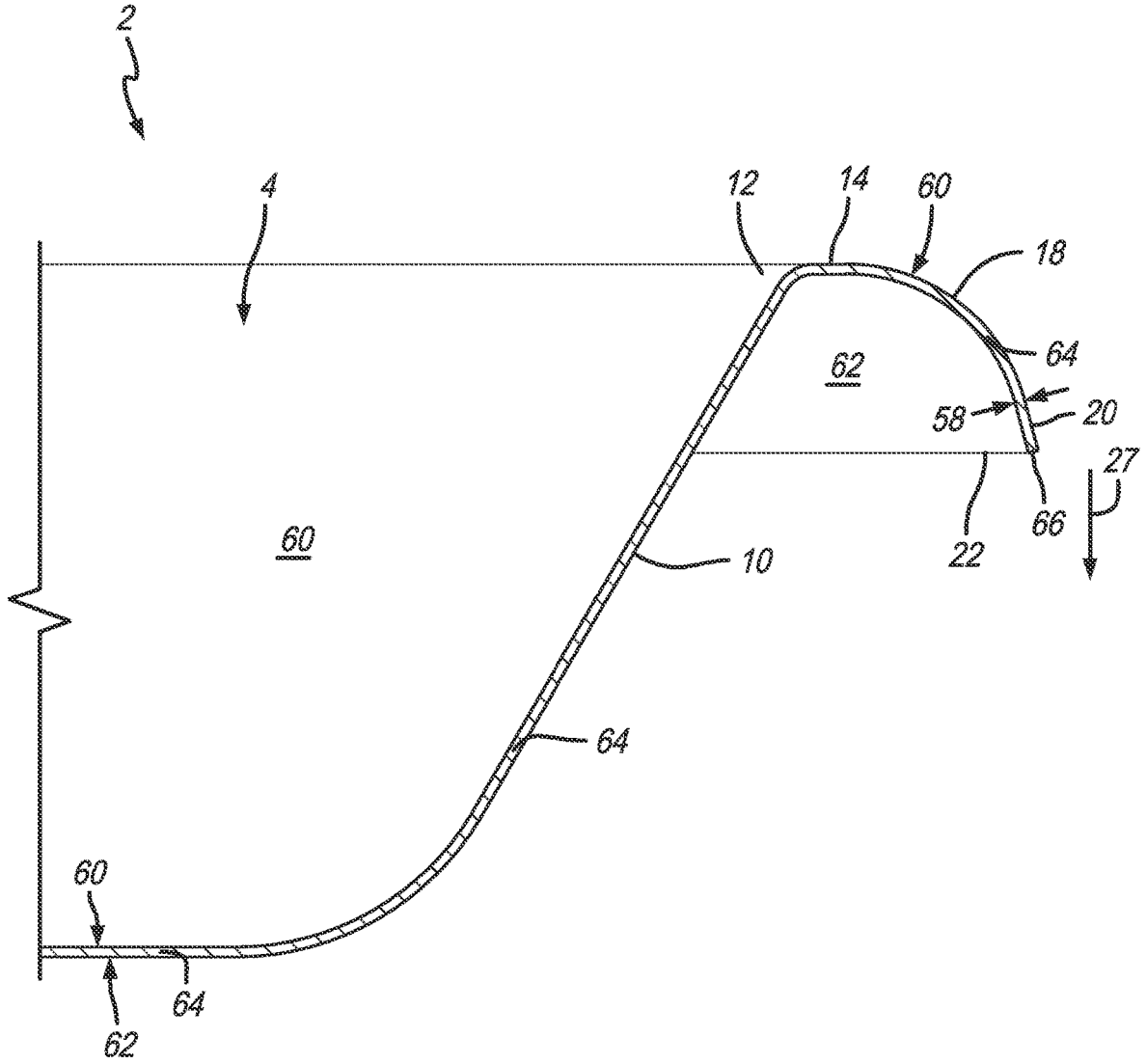
FIG. 4 is a partially cut-away detail perspective view of a portion of the paperboard meat tray.

A partially cutaway detail perspective view of a portion of paperboard meat tray 2 is shown in FIG. 4. Depicted here are better views of angled outer transition 12 extending from inclined sidewall 10, along with planar transition 14 extending from angled outer transition 12, opposite inclined sidewall 10. Outer rim 18 is shown extended from planar transition 14 opposite angled outer transition 12. Planar flange 20 is shown extended downwardly in direction 27 and terminating at edge 22. It is also appreciated in this view how the material of meat tray 2 is cardboard or paperboard having a thickness as indicated at 58. It will be appreciated that both front surface 60 and rear surface 62, located opposite front surface 60, may be coated with a polymer moisture resistant coating. This means when moist meat is placed within tray cavity 4, it will come into contact with the polymer surface of front surface 60, which will serve as a barrier against any liquid penetrating into body 64 of the paperboard meat tray 2. Even if liquid were to come into contact with rear surface 62 from outside of tray cavity 4, the poly-film barrier will prevent moisture from penetrating into body 64 of the paperboard that forms meat tray 2. This is advantageous because, if moisture were to come into contact with the cellulosic fibers of body 64, the moisture will proceed to quickly degrade those fibers and cause meat tray 2 to fail. As such, a primary characteristic of paperboard meat tray 2 is to not allow any moisture from the meat to contact body 64 of meat tray 2. This is conventionally achieved by the polymer material applied to front surface 60 and rear surface 62. With angled outer transition 12, planar transition 14, outer rim 18, and planar flange 20, the same polymer material coats their front surface 60 and rear surface 62 as well. The problem comes at edge 22. As shown herein, edge 22 is an exposed body end 66 which is a surface not having any poly-film material coated thereon to protect from moisture. Body end 66 is the cellulosic fiber material previously discussed with body 64, but is now exposed. If any moisture were to come into contact with body end 66 of edge 22, the cellulosic fibers will quickly wick that moisture up into body 64 creating the aforedescribed degradation of meat tray 2 irrespective of the polymer material that coats front and rear surfaces 60 and 62, respectively. In other words, body end 66 of edge 22 is a vulnerable spot of meat tray 2. That is why it is positioned specifically outside of tray cavity 4 and away from tray cavity 4. The plastic wrap will tend to seal against the outer flange which appears to prevent the moisture migration and protect the exposed outer edge from the moisture.

Figure 5:
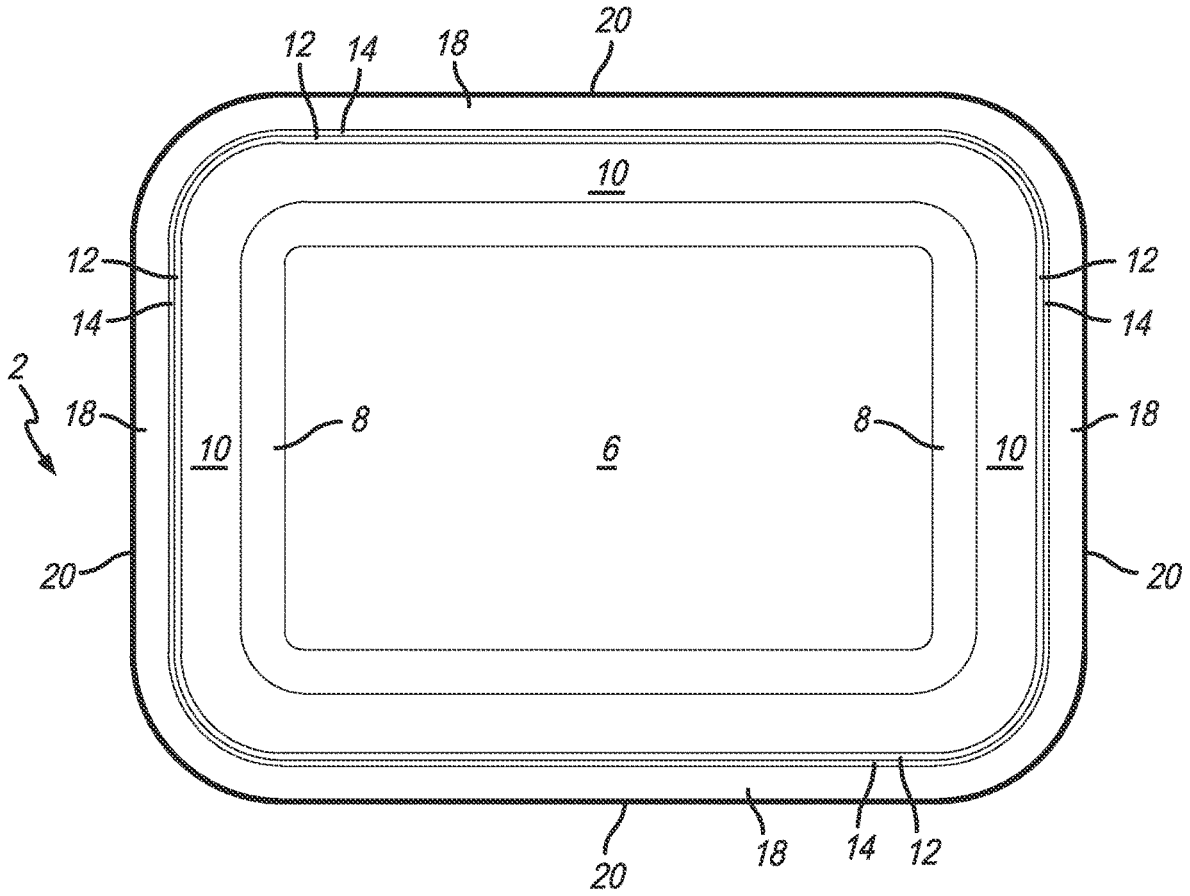
FIG. 5 is a top view of the paperboard meat tray.

A top view of meat tray 2 is the shown in FIG. 5. This view shows the continuous arrangement of upward base transition 8, inclined sidewall 10, angled outer transition 12, planar transition 14, outer rim 18, and planar flange 20 about planar base 6 to form meat tray 2. Again, the illustrative shape of meat tray 2 is rectangular. It is appreciated, however, that these same structures shown herein may be formed in any of a variety of other configurations such as oval, round, square, irregularly shaped, etc. The shape of the footprint, according to the scope of this disclosure, does not affect the salient characteristics of the planar base, upward base transition, inclined sidewalls, angled outer transition, planar transition, outer rim, or planar flange.

Figure 6:
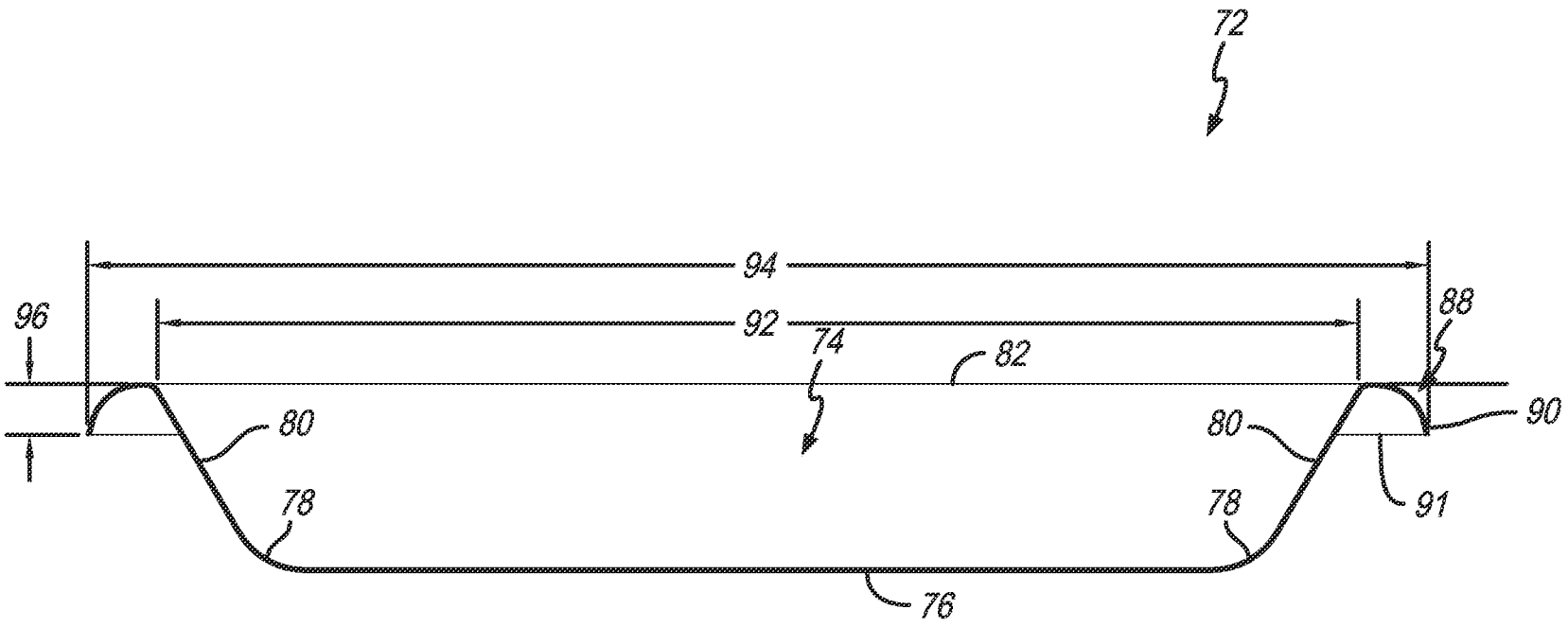
FIG. 6 is a side cross-sectional view of the paperboard meat tray.
Figure 7:
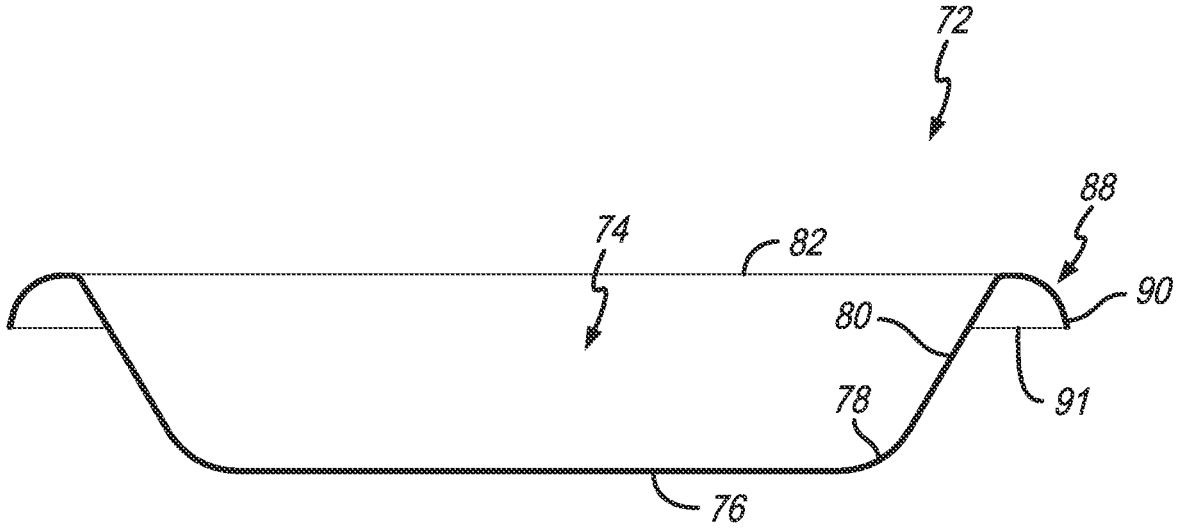
FIG. 7 is a cross-sectional end view of the paperboard meat tray.
Figure 8:
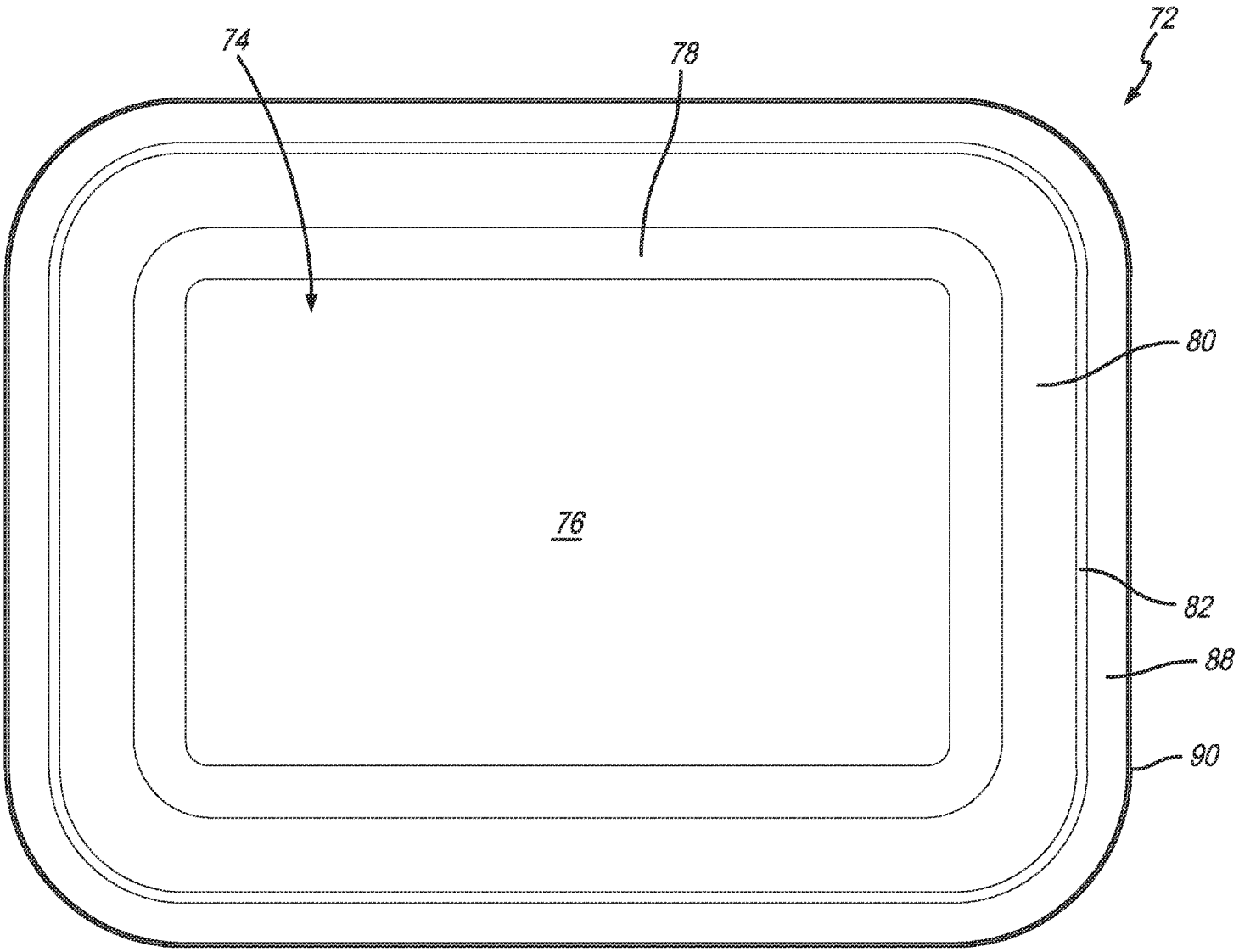
FIG. 8 is a top view of the paperboard meat tray.

Another illustrative embodiment of the present disclosure provides a paperboard paperboard meat tray 72, as shown in FIGS. 6, 7, and 8. Paperboard meat tray 72 is similar to meat tray 2 of the prior embodiment, except that meat tray 72 does not include a planar transition such as planar transition 14 on paperboard meat tray 2. Rather, meat tray 72 includes an outer rim 88 that curvingly extends from angled outer transition 82, as shown in FIGS. 6, 7, and 8. In this embodiment, eliminating the planar transition reduces the amount of paper used and decreases the outer perimeter size of the tray which reduces cost.

The side cutaway view of paperboard meat tray 72, shown in FIG. 6, also includes a planar base 76 ending at upward base transition 78. An inclined sidewall 80 is similar to inclined sidewall 10 shown in FIG. 1 with paperboard meat tray 2. The combination of planar base 76, upward base transition 78, and inclined sidewall 80 form tray cavity 74, is similar to tray cavity 4 of meat tray 2 shown in FIG. 2. Angled outer transition 82 extends outwardly from tray cavity 74 at the end of inclined sidewall 80 opposite of upward base transition 78. In this illustrative embodiment, outer rim 88 extends from angled outer transition 82 away from tray cavity 74. As such, outer rim 88 is located outside tray cavity 74. Similar to planar flange 20 shown in FIG. 2, a planar flange 90 extends from outer rim 88 opposite angled outer transition 82.

The view in FIG. 6 also depicts illustrative dimensions for this embodiment of paperboard meat tray 72. It is appreciated in this embodiment that the dimensions of the tray cavity is indicated at line 92 which is the same dimension as that shown with respect to tray cavity 4 of meat tray 2 shown in FIG. 3. However, the dimension of the overall tray in this illustrative embodiment is slightly shorter as indicated by line 94 than the corresponding dimension indicated at line 38 of meat tray 2 in FIG. 3. It is further appreciated that the other dimensions of illustrative meat tray 72 are the same as illustrative meat tray 2 with the exception of the height indicated by line 96 of outer rim 88. In this embodiment, outer rim 88 is about 11/32 inch rather than 5/16 inch as shown by dimension 50 in FIG. 3. This is to account for the elimination of planar transition 14, as shown in meat tray 2 of FIG. 3.

The cross-sectional end view of meat tray 72 is shown in FIG. 7. This view further depicts planar base 76, extending to upward base transition 78, having inclined sidewall 80 extending therefrom, opposite planar base 76. Angled outer transition 82 forms the top edge of tray cavity 74, and extends to outer rim 88 and planar flange 90 as previously discussed. Edge 91 is similar to edge 22 included on paperboard meat tray 2 and suffers from the same issues.

The top view of meat tray 72 with planar base 76, upward base transition 78, and inclined sidewall 80, is shown in FIG. 8. This view depicts how meat tray 72 is of similar shape to paperboard meat tray 2 as shown in FIG. 5. Accordingly, angled outer transition 82 is shown extending from inclined sidewall 80, opposite upward base transition 78, and extending away from tray cavity 74. Outer rim 88 and planar flange 90 are shown extending outwardly from angled outer transition 82 opposite inclined sidewall 80.

Another component of making a paperboard meat tray replacement to conventional foam meat trays is that it will be inexpensive. A component of the expense of making paperboard plates, trays, containers, etc. is their manufacturing process. A component of the manufacturing process is the die-set employed to stamp the paperboard into a tray shape. No paperboard-based meat tray can serve as a replacement if it is not inexpensive enough to compete price-wise with conventional foam trays. As such, an illustrative embodiment of the present disclosure marries both the structural characteristics that prevent moisture from wicking between the surfaces of the paperboard tray while at the same time that tray being made by a die set that includes fewer components and, thus, being simpler than prior tray stamping die sets so as to be less expensive.

Accordingly, another illustrative embodiment of the present disclosure provides a die set that, when used by a press, forms paperboard meat tray 2 (or paperboard meat tray 72), yet using a simpler die set arrangement. The prior art die set, as previously discussed, is composed of a male body supporting a spring-loaded male nose fitted within a draw ring and actuated secondary draw ring. Secondary draw ring actuating pins are included to support the actuated secondary draw ring. The spring-loaded ironing ring supported by the female cavity sets on the actuated secondary draw ring. The draw ring, in combination with the actuated secondary draw ring and spring-loaded ironing rings, supported by the actuating pins, move to form the tray's rim and fold under the edge to move same away from the inside of the tray that otherwise supports the tray contents.

Figure 9:
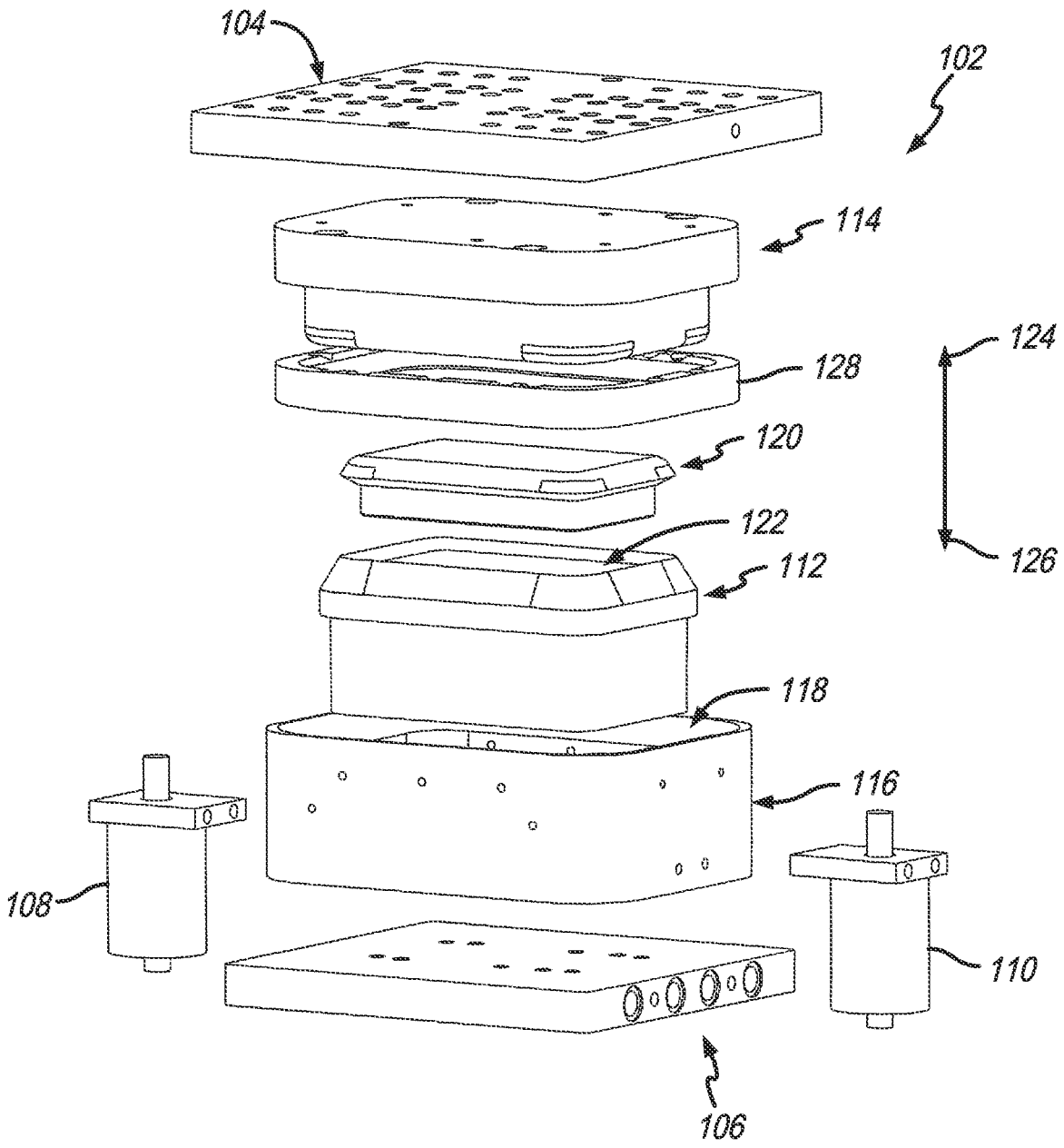
FIG. 9 is a perspective exploded view of a die set assembly located between upper and lower press plates.

Alternatively, a perspective exploded view of a die set assembly 102, located between upper press plate 104, and lower press plate 106, and illustratively between draw ring air cylinders 108 and 110, is shown in FIG. 9. Draw ring air cylinders 108 and 110 provide adjustable force to the draw ring required to control pleating of the paperboard blank. Die set assembly 102 includes a male body 112 and female cavity section 114. Male body 112 is sized to fit into seat 118 of draw ring 116 which is supported by lower press plate 106. Male nose 120 is sized to fit into male body cavity 122. Male nose 120 is illustratively spring-loaded to bias same in direction 124 towards female cavity section 114. It is appreciated that to make a meat tray, such as meat trays 2 and 72 as previously described, a sheet of paperboard will be placed between the spring-loaded male nose 120 and female cavity section 114 which join and are pressed together via upper and lower press plates 104 and 106, respectively, to form the paperboard sheet into the meat tray. A spring-loaded ironing ring 128 is fitted about the periphery of female cavity section 114 to further assist forming the meat tray into shape. It is further appreciated from this view that neither an actuated ironing ring, nor any ironing ring actuating pins, are needed for die set assembly 102.

Figure 10:
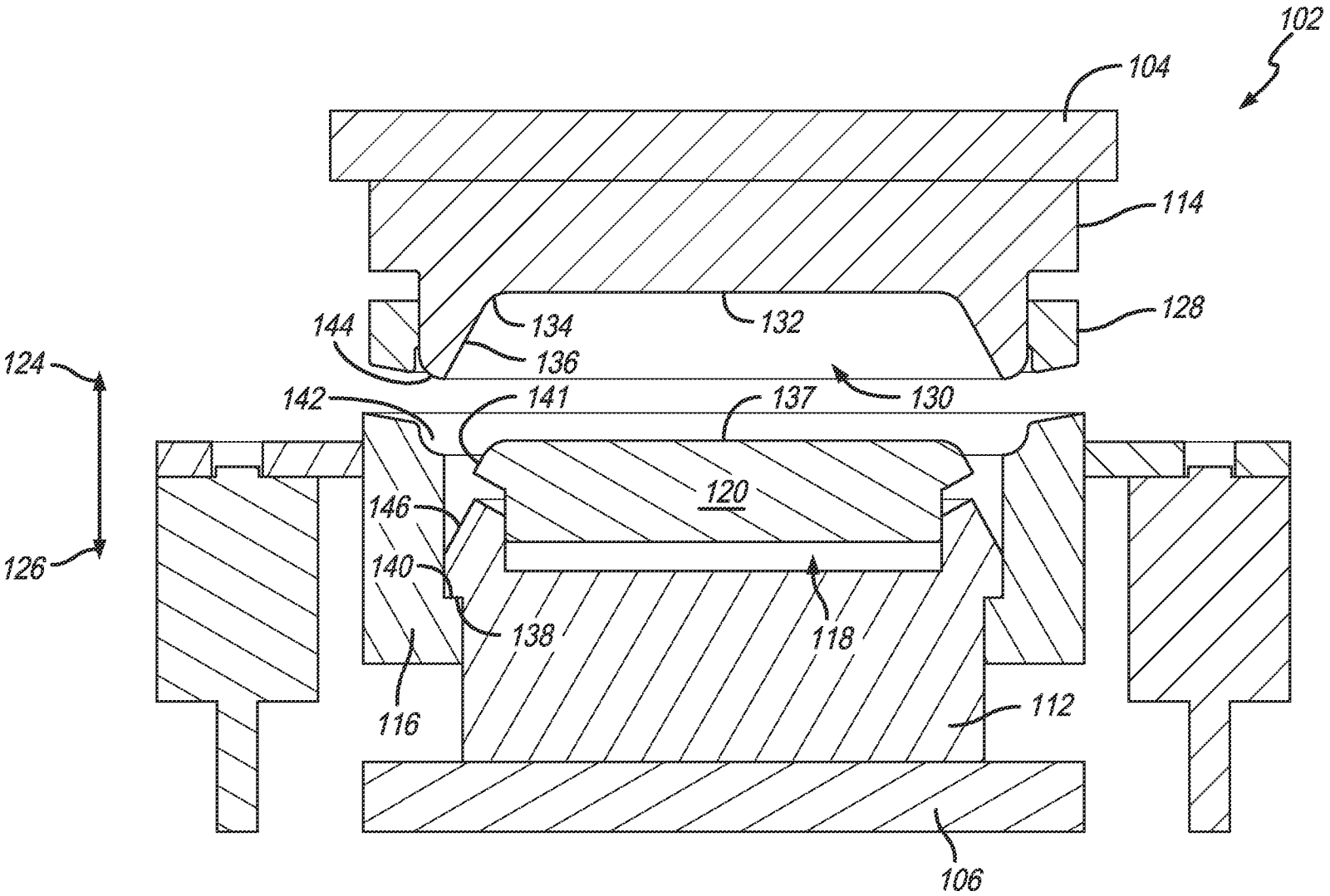
FIG. 10 is a cross-sectional view of the die set assembly.
Figure 11:
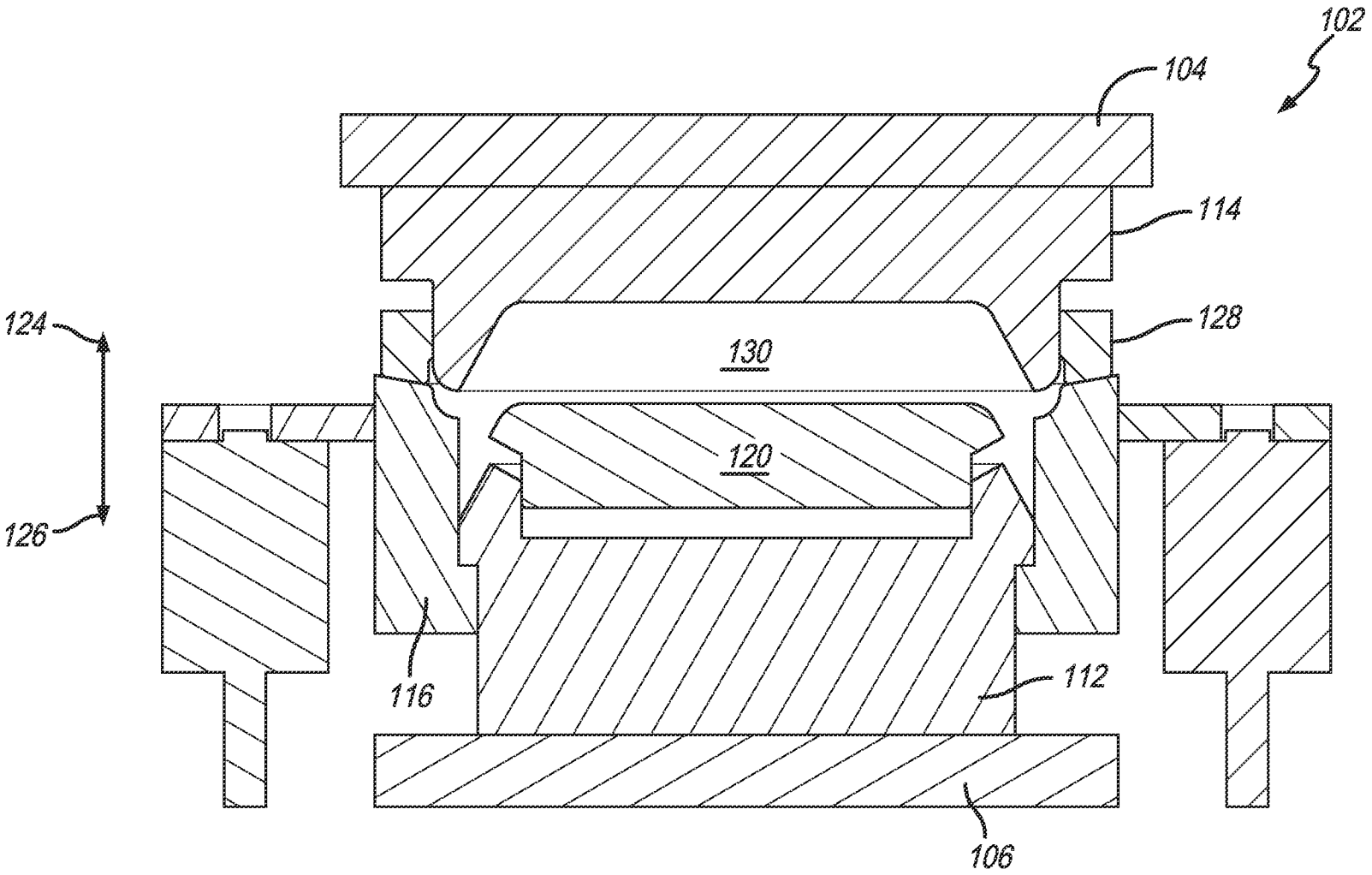
FIG. 11 is another cross-sectional view of the die set assembly.
Figure 12:
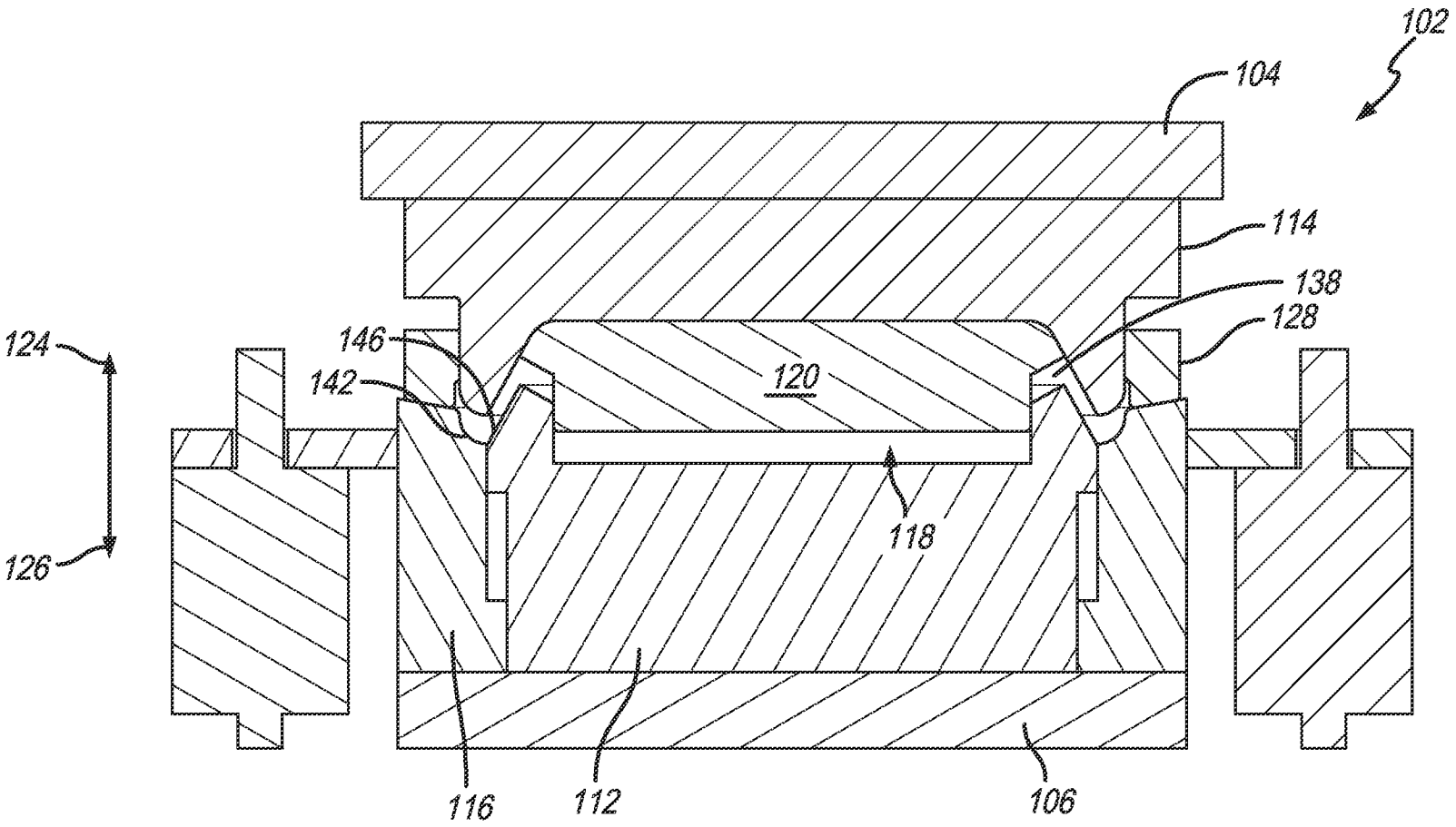
FIG. 12 is another cross-sectional view of the die set assembly.
Figure 13:
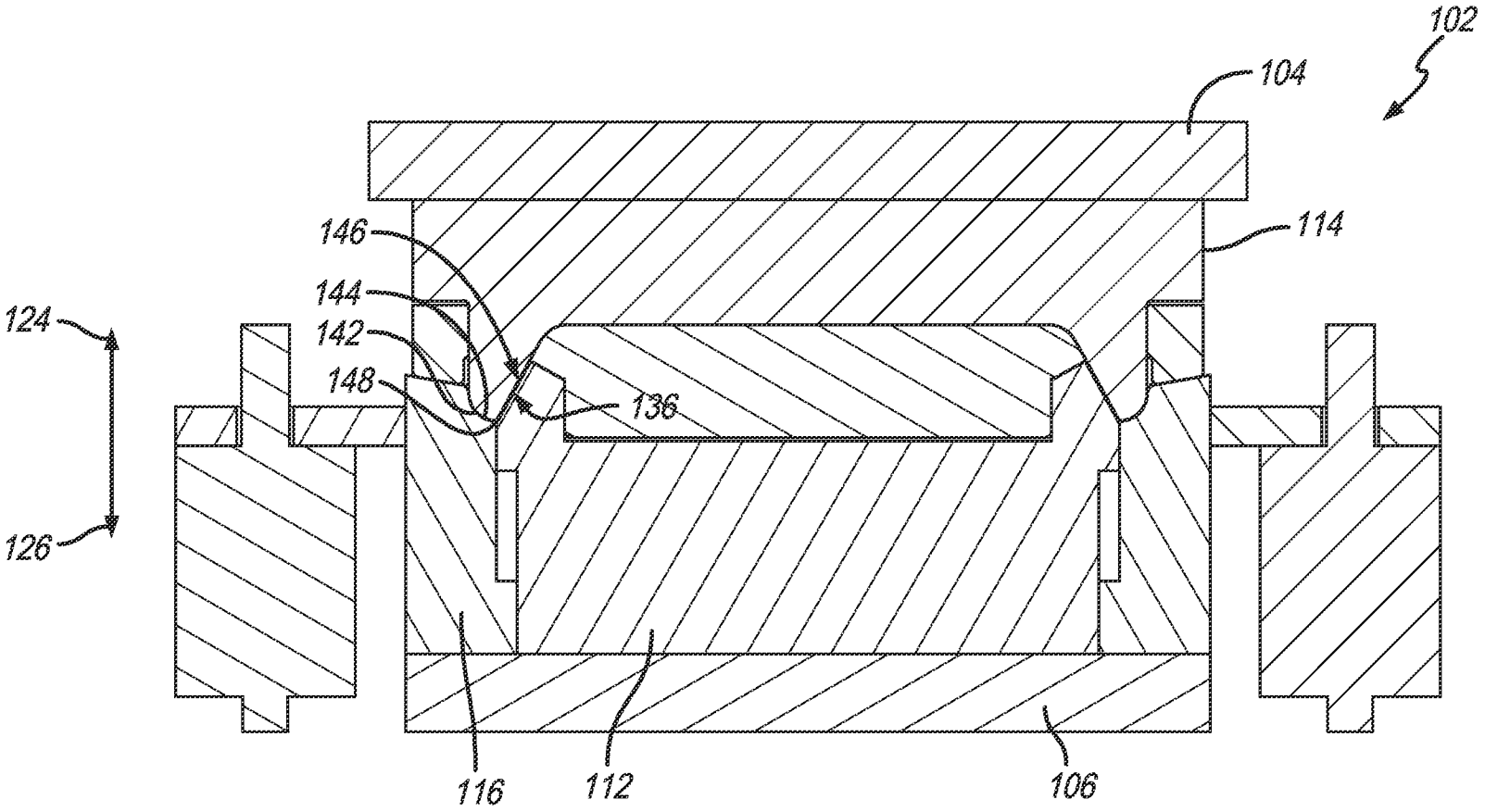
FIG. 13 is another cross-sectional view of the die set assembly.

A cross-sectional view of die set assembly 102, positioned in its pre-meat tray forming position, is shown in FIG. 10. Similar views of die set assembly 102 are also shown in FIGS. 11, 12, and 13. These views will demonstrate the method of forming a flat paperboard blank into the meat trays as shown in FIGS. 1 through 8. As shown in FIG. 10, female cavity section 114 is mounted onto upper press plate 104. Spring-loaded ironing ring 128 is positioned adjacent to the end of female cavity section 114 as shown. Spring-loaded ironing ring 128 is configured to be biased in direction 126. Ironing ring 128 supports and prevents the blank from being stretched around the flange while the paper is being drawn into the cavity, reducing the stress on the paperboard.

A cavity 130 is formed within female cavity section 114. Cavity 130 includes planar base surface portion 132, upward-based transition portion 134, and inclined sidewall portion 136, which form the shape of the corresponding planar base 6, upward-based transition 8, and inclined sidewall 10 of meat tray 2 shown in FIGS. 1 through 5. Male nose 120, in this view, separated from cavity 130, includes corresponding surfaces 137, 139, and 141, respectively, that when joined in cavity 130, forms the shape of tray cavity 4 by those aforementioned sections of meat tray 2. This view further shows how male nose 120 is fitted into seat 118. Male body 112 is affixed to lower press plate 106 with draw ring 116 moved in direction 124 to its upper position. Catch 138 illustratively located about the periphery of male body 112 is configured to engage ledge 140 on draw ring 116 to limit the movement of draw ring 116 with respect to male body 112. Draw ring 116 also includes a curved collar 142 which is sized and shaped to complement curved periphery 144 of female cavity section 114 to form the angled outer transition 12, planar transition 14 (with respect to meat tray 2), outer rim 18, and planar flange 20. It is appreciated that the precise shape of curved collar 142 and complementary curved periphery 144 may alternately be shaped to either include the planar transition 14 when pressing meat tray 2 or may not include planar transition 14 when pressing meat tray 72. Male body 112 also includes an outer periphery 146 that extends surface 141 and meets with inclined sidewall portion 136 to form inclined sidewall 10 of paperboard meat tray 2.

In the view shown in FIG. 11, upper and lower press plates 104 and 106 are drawn together in directions 126 and 124, respectively, to begin bringing the components of die set assembly 102 together. As shown in this view, female cavity section 114 is aligned with male body 112 and spring-loaded ironing ring 128 engages draw ring 116 as illustratively shown. At this point, cavity 130 has not yet engaged male nose 120. It is appreciated that a paperboard blank (not shown) would be positioned between cavity 130 and male nose 120. Also in this view, spring-loaded ironing ring 128 has not yet moved draw ring 116 downward in direction 126.

The view shown in FIG. 12 depicts upper press plate 104 and lower press plate 106 drawn together in directions 126 and 124, respectively, closer together than shown in FIG. 11. Here, spring-loaded ironing ring 128 further engages draw ring 116 pushing same downward in direction 126. In the positioning as shown, draw ring 116 abuts lower press plate 106 which causes curved collar 142 to be in proper position with respect to outer periphery 146 on male body 112 to form the press shape that can form inclined sidewall 10, angled outer transition 12, planar transition 14, outer rim 18, and planar flange 20 portions of meat tray 2. Also shown in this view is male nose 120 fitted in cavity 130 of female cavity section 114. The movement of upper and lower press plate sections 104 and 106 toward each other, overcomes any bias male nose 120 has in direction 124, and causes male nose 120 to be seated properly within cavity 130. This begins pressing planar base 6, upward base transition 8, and a portion of inclined sidewall 10 in the paperboard blank to form meat tray 2. It is further appreciated in this illustrative embodiment that these cavity structures (i.e., planar base 6, upward-based transition 8, and inclined sidewall 10 portion) are formed prior to the formation of angled outer transition 12, planar transition 14, outer rim 18, in planar flange 20.

The view of upper press plate 104 and lower press plate 106 moved further in directions 126 and 124, respectively, as shown in FIG. 13, have joined male body 112 and female cavity section 114 together to form meat tray 2 out of a paperboard blank. Here, female cavity section 114 is moved further in direction 126 so as to cause inclined sidewall portion 136 of cavity 130 (see FIG. 10) to cause a paperboard blank to form inclined sidewall 10 portion of meat tray 2. Additionally, curved collar 142 of draw ring 116 is abutted by curved periphery 144 of female cavity section 114 to form planar transition 14, outer rim 18, and planar flange 20 from the paperboard blank. Additionally, the joining of curved collar 142, curved periphery 144, and outer periphery 146, form vertex 148 of angled outer transition 12 in the paperboard blank. At this stage, the paperboard blank is now formed into meat tray 2.

It will be appreciated by the skilled artisan upon reading this disclosure that curved collar 142, of draw ring 116, and curved periphery 144 of female cavity section 114, can be modified so as to omit the planar transition, such as planar transition 14, between angled outer transition 12 and outer rim 18 of meat tray 2. It is further appreciated that these structures identified herein with respect to die set assembly 102 may be modified to change the profile as needed to create alternate embodiments of a meat tray as previously discussed herein.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that, to the extent any subject matter disclosed in this non-provisional Patent Application differs from the priority Application, the disclosure from this non-provisional Patent Application controls.

What is claimed:

1. A meat tray sized and shaped to support raw meat, the meat tray is composed of a paperboard material, the meat tray comprising:

a generally planar base;

at least one sidewall;

wherein the generally planar base extends to the at least one sidewall;

wherein the at least one sidewall has a smooth interior surface along its linear extent;

wherein the at least one sidewall extends transversely from the generally planar base to an angled outer transition which forms an outer periphery of a tray cavity;

wherein a reference plane extends from the angled outer transition of the meat tray opposite the generally planar base;

a rim of the meat tray is located at a terminus of the angled outer transition from the at least one sidewall;

wherein the rim includes a rim portion that extends adjacent the at least one sidewall and extends away from the tray cavity;

wherein the rim portion has a smooth surface adjacent the smooth interior surface along the linear extent of the at least one sidewall;

wherein the rim portion includes:

a planar transition having a smooth surface that extends adjacent the angled outer transition of the at least one sidewall and away from the tray cavity;

an outer arcuate rim portion having a smooth surface that extends from the planar transition adjacent the angled outer transition from the at least one sidewall, wherein the outer arcuate rim portion curves away from the reference plane;

wherein the outer arcuate rim portion has a radius of about 5/16 inch; and a planar flange having a smooth surface that extends adjacent the outer arcuate rim portion which is located adjacent the planar transition adjacent the angled outer transition from the at least one sidewall;

wherein the planar flange terminates at an edge; and wherein the smooth surface of the planar flange is located between the outer arcuate rim portion and a body end of the meat tray.

2. The meat tray of claim 1, wherein a peripheral shape of the meat tray is selected from the group consisting of round, oval, square, triangular, and irregularly shaped.

3. The meat tray of claim 1, further comprising a sheet of plastic wrap configured to be placed over the tray cavity and onto the smooth surface of the planar flange of the meat tray.

4. The meat tray of claim 1, wherein the radius of the angled outer transition is about 0 inch to about 1/16 inch.

5. The meat tray of claim 1, wherein the at least one sidewall is a plurality of sidewalls.

6. The meat tray of claim 5, wherein the plurality of sidewalls includes a first sidewall and a second sidewall, and a corner located between the first sidewall and the second sidewall.

7. The meat tray of claim 1, wherein the angled outer transition has a radius, wherein the radius of the angled outer transition divided by a height of the meat tray is equal to or greater than about 0.

8. The meat tray of claim 1, wherein the planar flange has a length, and wherein the length of the planar flange divided by the length of the outer arcuate rim portion is less than about 1.

9. The meat tray of claim 1, wherein the at least one sidewall is angled with respect to a line about perpendicular to the generally planar base within a range of about 5° to about 80°.

10. The meat tray of claim 1, wherein the edge faces away from the reference plane.

11. A meat tray sized and shaped to support raw meat, the meat tray is composed of a paperboard material, the meat tray comprising:

a generally planar base;

wherein the generally planar base extends to at least one sidewall;

wherein the at least one sidewall has a smooth interior surface;

wherein the at least one sidewall extends transversely from the generally planar base to an angled outer transition which forms an outer periphery of a tray cavity;

wherein a reference plane extends from the angled outer transition of the meat tray opposite the generally planar base;

a rim of the meat tray extending from the angled outer transition of the at least one sidewall;

wherein the rim has a smooth surface adjacent the smooth interior surface of the at least one sidewall;

wherein the rim further includes:

a planar transition having a smooth surface that extends adjacent the angled outer transition of the at least one sidewall and away from the tray cavity;

an outer arcuate rim portion that extends from the planar transition adjacent the angled outer transition of the at least one sidewall, wherein the outer arcuate rim portion curves away from the reference plane;

wherein the angled outer transition has a radius of about 1/16 inch; and a planar flange that extends adjacent the outer arcuate rim portion which is located adjacent the planar transition adjacent the angled outer transition from the at least one sidewall;

wherein the planar flange terminates at an edge; and wherein the planar flange is located between the outer arcuate rim portion and a body end of the meat tray.

12. The meat tray of claim 11, wherein the outer arcuate rim portion has a smooth surface.

13. The meat tray of claim 11, wherein the rim includes a rim portion that extends adjacent the at least one sidewall and away from the tray cavity.

14. The meat tray of claim 11, wherein the outer arcuate rim portion has a radius of about 5/16 inch.

15. The meat tray of claim 11, wherein the planar flange has a smooth surface.

16. A meat tray sized and shaped to support raw meat, the meat tray is composed of a paperboard material, the meat tray comprising:

a generally planar base;

wherein the generally planar base extends to at least one sidewall;

wherein the at least one sidewall has a smooth interior surface;

wherein the at least one sidewall extends transversely from the generally planar base to an angled outer transition which forms an outer periphery of a tray cavity;

a rim of the meat tray extending from the angled outer transition of the at least one sidewall;

wherein the rim has a smooth surface adjacent the smooth interior surface of the at least one sidewall;

wherein the rim further includes:

a planar transition having a smooth surface that extends adjacent the angled outer transition of the at least one sidewall and away from the tray cavity;

an outer arcuate rim portion having a smooth surface that extends from the planar transition adjacent the angled outer transition of the at least one sidewall;

wherein the outer arcuate rim portion is curved;

wherein the angled outer transition has a radius of about 0 to about 1/16 inch; and a planar flange that extends adjacent the outer arcuate rim portion which is located adjacent the planar transition adjacent the angled outer transition from the at least one sidewall;

wherein the planar flange terminates at an edge; and wherein the planar flange is located between the outer arcuate rim portion and a body end of the meat tray.

17. The meat tray of claim 16, wherein a reference plane extends from the angled outer transition of the meat tray opposite the generally planar base and wherein the outer arcuate rim portion curves away from the reference plane.

18. The meat tray of claim 16, wherein the planar flange has a smooth surface.

19. The meat tray of claim 16, wherein the outer arcuate rim portion has a radius of about 5/16 inch.

20. The meat tray of claim 16, wherein a 0 inch of the radius of the angled outer transition is a sharp corner intersection with no tangential radius.

* * * * *